United States Patent [19]

Quest

[11] Patent Number: 4,498,653

[45] Date of Patent: Feb. 12, 1985

[54] ADAPTER FOR RECEIVING MULTI-HOOKS BRACKETS OF VARIOUS MODEL-DESIGNS

[76] Inventor: Thomas A. Quest, 9205 Timberline Dr., Omaha, Nebr. 68152

[21] Appl. No.: 499,289

[22] Filed: May 31, 1983

[51] Int. Cl.[3] ..... E04G 5/06; A47G 29/02

[52] U.S. Cl. ..... 248/225.2; 108/108; 248/243

[58] Field of Search ..... 248/243, 235, 225.2; 211/90, 187; 108/106, 107, 108, 110

[56] References Cited

U.S. PATENT DOCUMENTS

| | | | |
|---|---|---|---|
| 3,603,637 | 9/1971 | DePinto | 248/243 X |
| 3,730,477 | 5/1973 | Wavrunek | 248/243 |
| 3,848,364 | 11/1974 | Costruba | 248/243 X |
| 4,065,904 | 1/1978 | Taylor | 108/108 X |
| 4,442,992 | 4/1984 | Worrallo | 248/243 |

FOREIGN PATENT DOCUMENTS

| | | | |
|---|---|---|---|
| 904545 | 11/1945 | France | 248/354.4 |
| 466550 | 1/1969 | Sweden | 248/354 P |
| 690302 | 4/1953 | United Kingdom | 248/354.5 |
| 2064305 | 6/1981 | United Kingdom | 248/243 |

*Primary Examiner*—J. Franklin Foss

*Attorney, Agent, or Firm*—George R. Nimmer

[57] ABSTRACT

Multi-hooks brackets are utilized for suspendably supporting writing desks and other office equipment from an upright environmental wall, such as office-partitions, etc. The bracket hooks must reliably securely engage with a wall anchorable multi-apertured column, which might be incorporated into an office-partition or mounted to a conventional wall. The typical manufacturer of the multi-hooks brackets usually also manufactures mating multi-apertured columns. Thus, the manufacturer is free to arbitrarily select some "model-design" for these two mating components. Thus, "model-designs" vary from one manufacturer to another and are rarely interchangeable with components made by other manufacturers. Accordingly, the office equipment purchasing agent has practically no other source for multi-hooks brackets than the manufacturer of the previously purchased office-partition. The present invention provides an adapter that includes a novel receiver-bar type multi-apertures column having lateral adjustment and other special features whereby various "model-designs" of brackets might by utilized in conjunction with a previously selected office-partition or other type upright wall environment.

11 Claims, 13 Drawing Figures

FIG.4 (PRIOR ART)
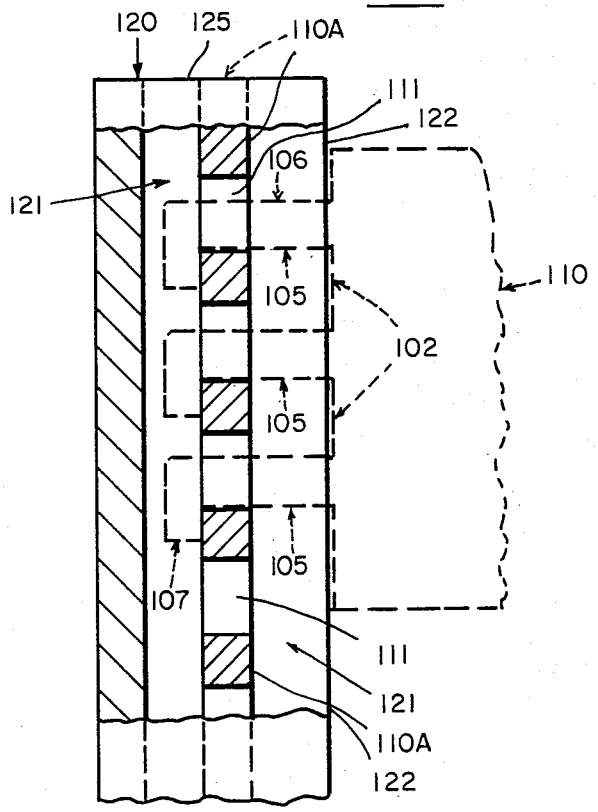
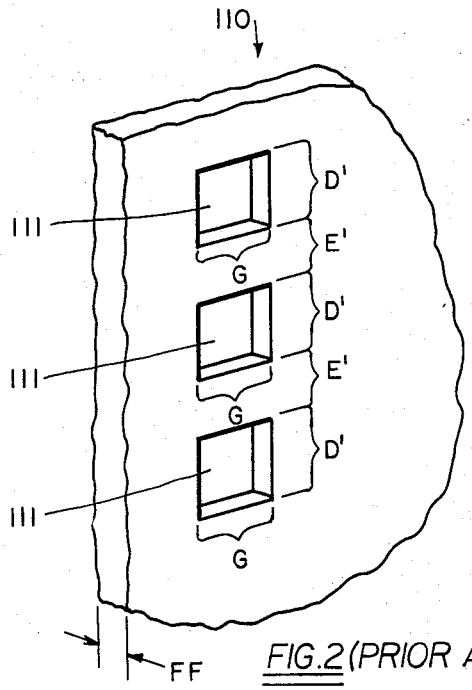
FIG.2 (PRIOR ART)
FIG.3 (PRIOR ART)
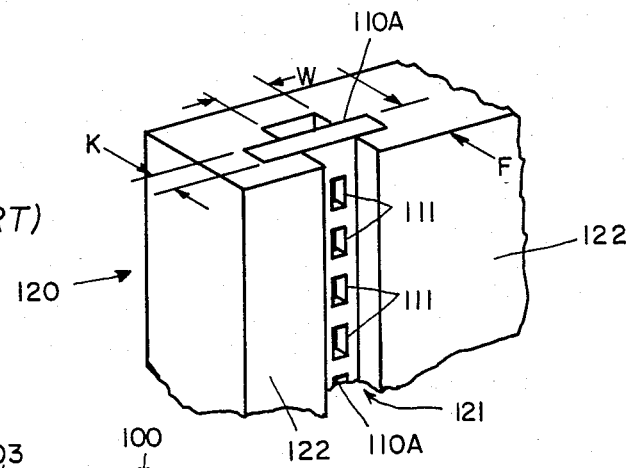
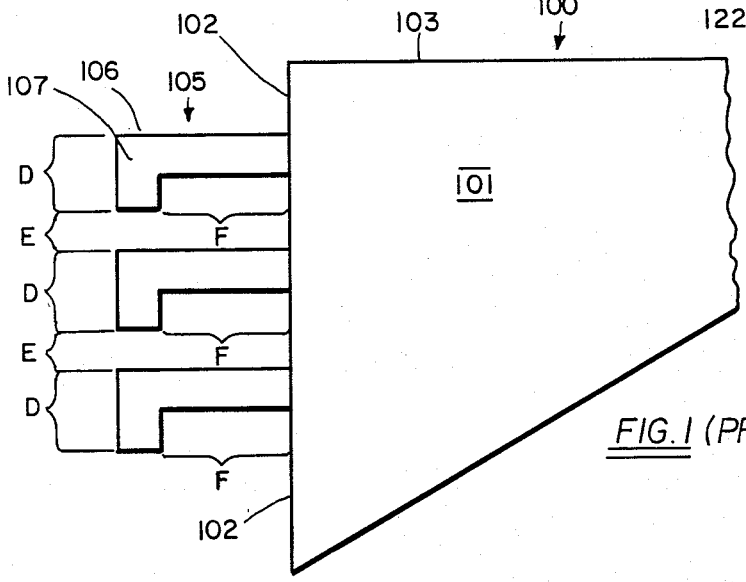
FIG.1 (PRIOR ART)

FIG.5
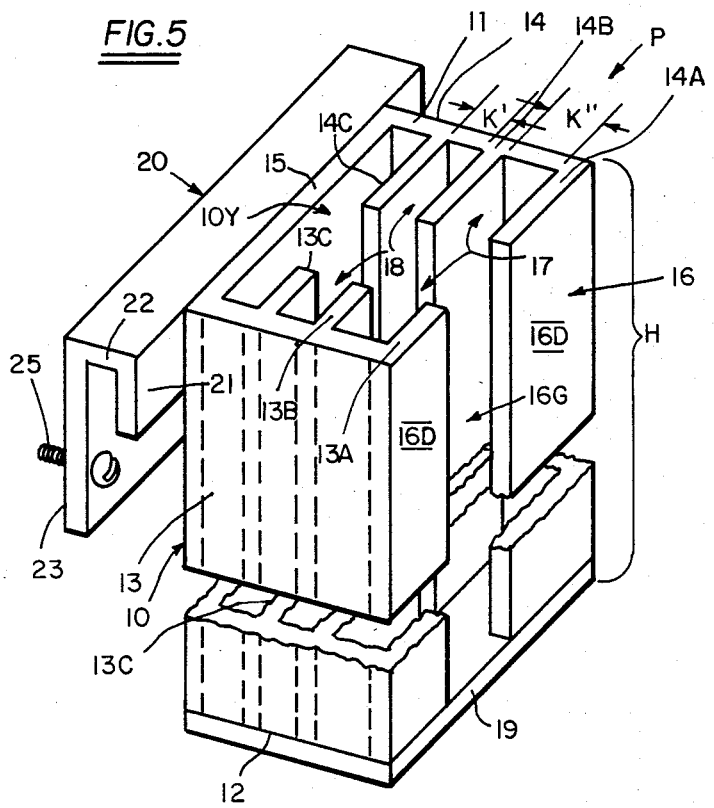
FIG.6
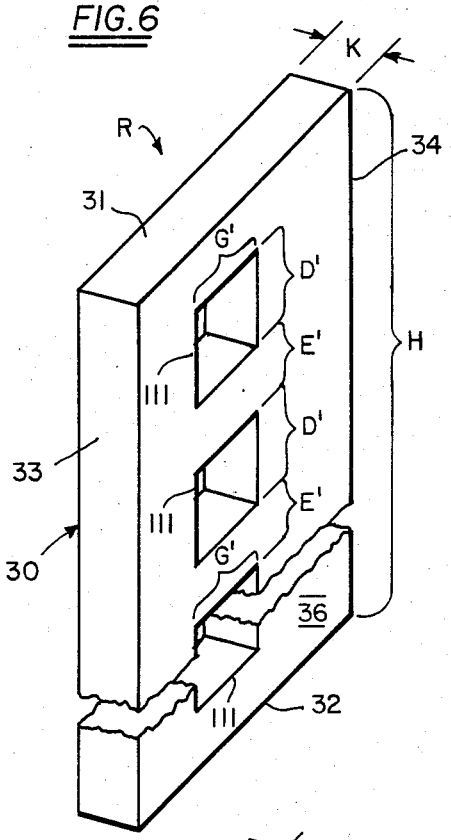
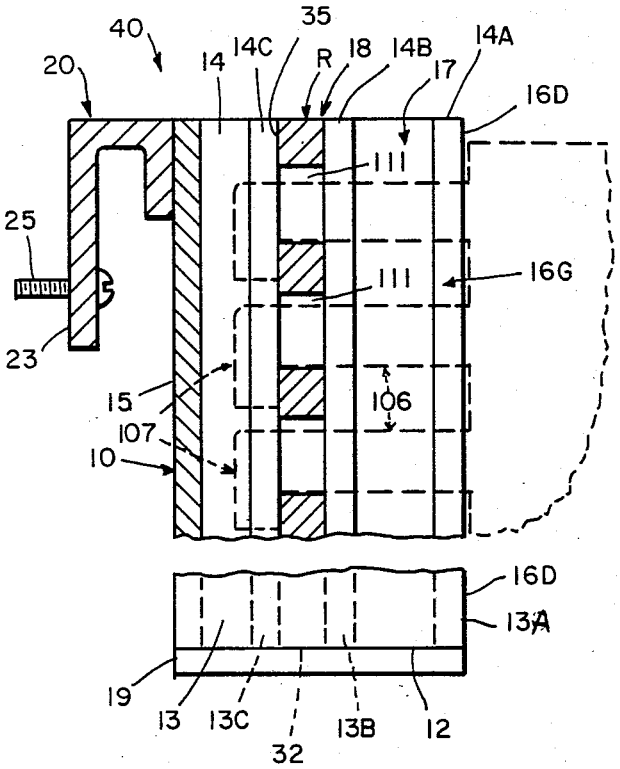
FIG.7
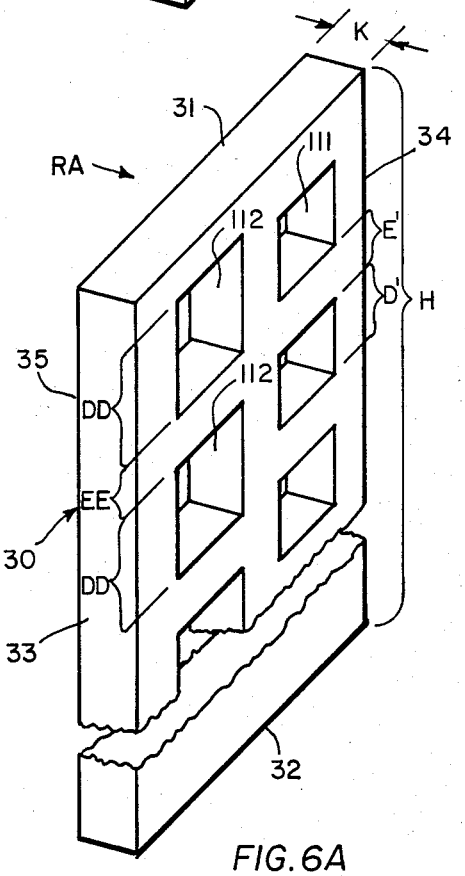
FIG.6A

FIG. 8
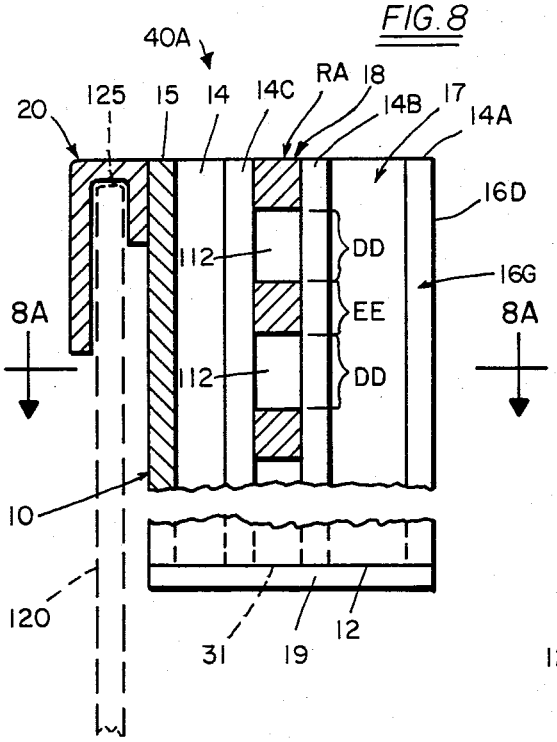
FIG. 8A
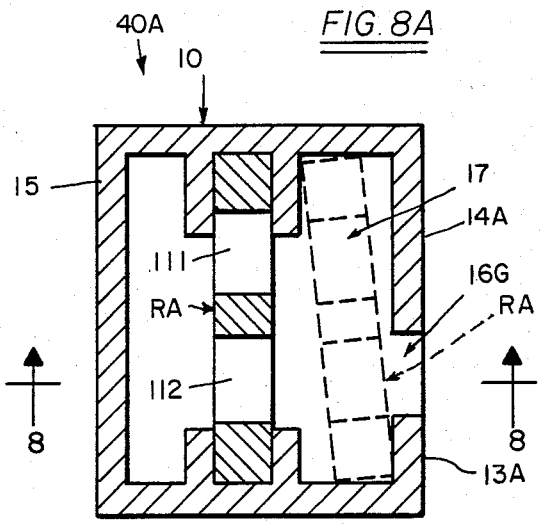
FIG. 6B
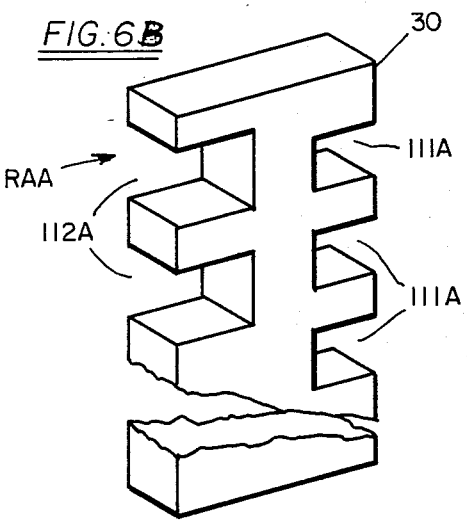
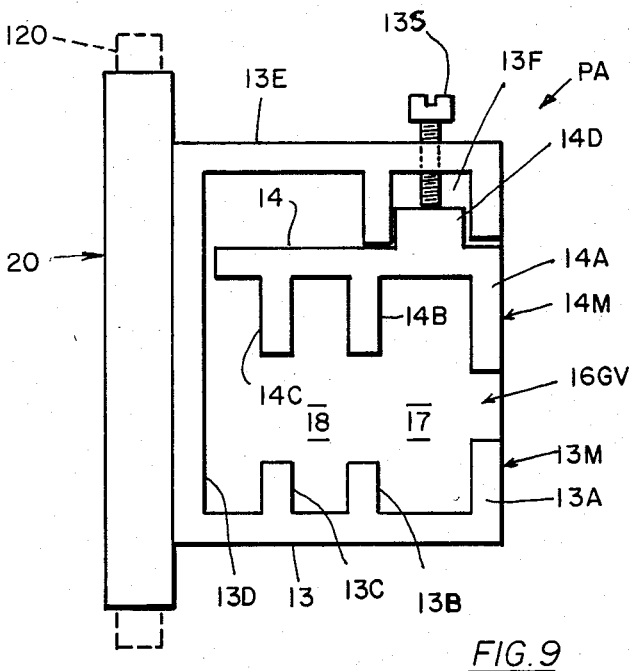
FIG. 9
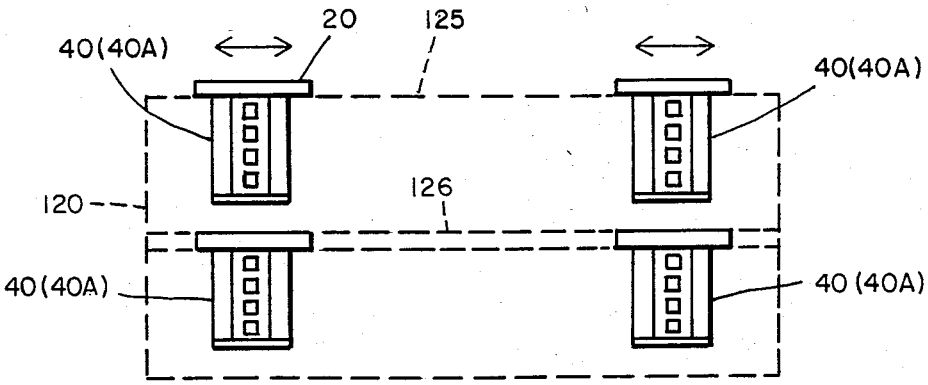
FIG. 10

ADAPTER FOR RECEIVING MULTI-HOOKS BRACKETS OF VARIOUS MODEL-DESIGNS

BACKGROUND OF THE INVENTION

Multi-hooks brackets, having their vertically spaced hooks engageable with the vertically aligned apertures of a multi-apertures column anchored to an environmental wall, are commonly utilized for suspendably supporting writing desks and other office equipment from the office environmental wall. A current trend in office layout is to utilize low elevational office-partitions to provide cubicle offices, such office-partitions including therewithin the multi-apertured column for removably receiving such multi-hooks brackets.

Drawing FIG. 1 depicts a rudimentary multi-hooks bracket, removably engageable with a modern office-partition or other environmental wall provided with a multi-apertures column. Typical multi-hooks bracket 100 comprises an arm 101 (for suspendably supporting the desired office equipment), said arm 101 having a vertical rear-side 102 and a horizontal top-side 103 extending lengthily laterally forwardly from rear-side 102. Bracket 100 includes a plurality of vertically aligned hooks 105 extending laterally rearwardly of rear-side 102, each hook 105 comprising a horizontal shank 106 extending laterally rearwardly of rear-side 102 and a detent 107 extending downwardly from the shank rearward terminus. All hooks 105 are of some arbitrarily selected uniform shape and dimensional configuration, and are of a prescribed spatial relationship to each other and to the bracket rear-end (102), such selected configuration and spatial relationship determining the bracket "model-design". For example, the bracket 100 has a unique "model-design" including L-shaped hooks wherein the detents 107 are of the same detent-height D, a regular vertical-spacing E between the detents 107, and a constant lateral-spacing F between each detent 107 and the bracket rear-end 102.

Turning now to drawing FIG. 2 which depicts a multi-apertures column 110 having its apertures 111 appropriately designed and spaced to permit mateable engagement with the "model-design" bracket 100 of FIG. 1. In this vein, each horizontal aperture 111 of column 110 has an aperture-height D′ at least equal to detent-height D (with all aperture-heights D′ being substantially identical), wherein there is between apertures 111 a constant vertical-spacing E′, and wherein the horizontal lateral-extent FF of each aperture 111 is exceeded by detent lateral-spacing F.

Though the multi-apertures column 110 is anchorable to any appropriate environmental wall, such columns are oftentimes incorporated into upright office-partitions, such as that representative office-partition 120 of FIGS. 3 and 4. Typical office-partition 120 has an upright planar frontal-face 122 interrupted by a groove-like cleft 121 having a transverse width W slightly exceeding the aperture-width G′. A bar-like form 110A of the FIG. 2 column 110 transversely spans office-partition cleft 121 and is at a fixed lateral-spacing of substantially F from office-partition frontal-side 122. In FIG. 4, phantom line indicates the removably engaged condition for bracket 100 with the multi-apertures column 110A, parts 100 and 110A being necessarily of related "model-design".

The typical manufacturer of the multi-hooks brackets usually also manufacturers mating multi-apertured columns (usually in the form of office-partitions). Thus, the manufacturer is free to arbitrarily select its own unique "model-design" for the two mating components. As would be suspected, "model-designs" vary from one manufacturer to the other and are rarely interchangeable with components emanating from a competitive manufacturer. Because of the lack of interchangeability, the office equipment purchasing agent has practically no other choice than to purchase multi-hooks brackets from the manufacturer of the previously purchased office-partition. Thus, the purchasing agent is substantially foreclosed from seeking competitive bids on the multi-hooks brackets he wishes to purchase in the future.

OBJECT OF THE INVENTION

It is accordingly the general objective of the present invention to provide an adapter for receiving multi-hooks brackets of various "model-designs", and specifically including a multi-apertures column portion that is not restricted to a single "model-design" bracket whereby the office manager might be freed to purchase office equipment suspension brackets from various manufacturers. It is a related and ancillary general objective to provide a novel and versatile adapter for enabling an office manager to utilize various "model-designs" of brackets at various wall environments, including office-partitions having unstandardized multi-apertures columns that may have already been purchased and that represents a valuable capital asset to the office manager.

GENERAL DESCRIPTION OF THE INVENTION

With the aforestated general objective in view, and other specific objectives which will become more apparent as this description proceeds, the adapter concept of the present invention generally comprises: an uprightly extending frontal-panel, preferably in the form of a tubular housing, there being associated with the frontal-panel anchoring means for anchoring the adapter to an upright wall environment, the tubular housing including a vertical-bore of prescribed cross-sectional shape; a vertical receiver-bar provided with at least a first-row of vertically aligned apertures at a regular vertical-spacing of a first-spacing value, and desireably a second-row of vertically aligned apertures having a regular vertical-spacing at a frequency different from the first-row vertical-spacing; and lateral adjustment means for installing the receiver-bar at a selectable lateral-distance from the frontal-panel and in alignment with a vertical-groove slot thereat, and the lateral adjustment means preferably taking the form wherein the housing vertical-bore cross-sectional shape includes a plurality of laterally consecutive channels selectable for receiving therein the multi-apertures receiver-bar.

BRIEF DESCRIPTION OF THE DRAWINGS

In the drawings, wherein like characters refer to like parts in the several views, and in which:

FIG. 1 is a side elevational view of a representative multi-hooks bracket of the prior art having an arbitrarily selected "model-design" at the vertically aligned hooks portion thereof;

FIG. 2 is a perspective view of a multi-apertures column of the prior art having a "model-design" similar to and mateable with the hooks of the FIG. 1 bracket;

FIG. 3 is a perspective view of a typical prior art office-partition having included a multi-apertures column akin to that of FIG. 2;

FIG. 4 is a side elevational view of the removably engageable combination of the FIG. 1 bracket and the FIG. 3 multi-apertures column;

FIG. 5 is a perspective view of a housing component which is utilized for the first and the second embodiments of the adapter of the present invention;

FIG. 6 is a perspective view of a single-row type receiver-bar component employed for the adapter first embodiment shown in FIG. 7;

FIG. 7 is an elevational view, partly in section, and similar to FIG. 4, of the adapter first embodiment;

FIG. 6A is a perspective view of a two-rows type receiver-bar component employed for the adapter second embodiment shown in FIGS. 8 and 8A;

FIG. 6B is a perspective view of a modified form of the FIG. 6A receiver-bar embodiment;

FIG. 8 is an elevational view, similar to FIGS. 4 and 7, of the adapter second embodiment;

FIG. 8A is a sectional plan view taken along line 8A—8A of FIG. 8;

FIG. 9 is a top plan view of an alternate housing component which might be substituted for the FIG. 5 housing component; and FIG. 10 is an elevational view of adapters in combination with a representative environmental wall.

DETAILED DESCRIPTION OF THE DRAWINGS

As seen in FIG. 7, adapter first embodiment 40 comprises multi-apertures receiver-bar R of FIG. 6 in laterally separated relationship to datum frontal-panel 16 that might be incorporated into the wall anchorable tubular housing component P of FIG. 5.

Housing member P of FIG. 5 includes an upright tubular portion 10 having a finite-height H between top-end 11 and bottom-end 12. Tubular member 10 has a bore 10Y of a regular non-circular cross-sectional shape and includes four interconnected upright panels including; transversely extending datum frontal-panel 16 and rear-panel 15; and laterally extending leftside-panel 13 and rightside-panel 14. Datum frontal-panel 16 has a frontal-face occupying a transversely and uprightly extending frontalface-plane 16D, and is divided into transversely separated left-panel 13A and right-panel 14A by a coextensive vertical-groove slot 16G that communicates therealong with vertical-bore 10Y.

As already alluded to, there are lateral adjustment means for permitting the multi-apertures receiver-bar (e.g. R, RA, RAA, etc.) to be installed at a selectable lateral distance from the datum frontal-panel (16). In the case of the tubular member type (10) frontal-panel, the lateral adjustment means is furnished by providing a plurality of laterally consecutive channels into the housing vertical-bore 10Y. In this vein, housing 10 might have its leftside-panel 13 provided with laterally incrementally spaced leftward shoulders 13A, 13B, and 13C, and might have its rightside-panel 14 provided with similarly laterally incrementally spaced rightward shoulders 14A, 14B, and 14C. Similarly as with the transversely separated (16G) shoulders 13A and 14A, the remaining shoulders (13A and 14B, 13C and 14C) are also transversely separated from each other. Thus, each interior channel of the housing member is provided by a pair of transversely separated bifurcate housing wings. For example, forwardmost channel 17 is provided by leftward-wing (13A+13B) transversely separated by rightward-wing (14A+14B), and the next channel 18 is provided by leftward-wing (13B+13C) transversely separated from rightward-wing (14B+14C). Though the drawing shows tubular housing 10 provided with only two receiver-bar channels (17 and 18), additional such channels might be provided rearwardly of channel 18 i.e. by providing additional shoulders laterally consecutively spaced rearwardly of housing shoulders 13C and 14C. The bottom-end 12 of tubular member 10 is shown closed by a horizontal base-plate 19 attached thereat. Housing component P, in addition to tubular member 10 and base-plate 19, includes anchoring means (e.g. 20) which will be explained later in greater detail.

Turning now to FIG. 6, the receiver-bar member R for adapter first embodiment 40 is similar to the bar-like multi-apertures column 110A depicted in FIG. 3. Receiver-bar R comprises a columnar bar 30 of metal or other sturdy structural material, said bar 30 between top-edge 31 and bottom-edge 32 being of height substantially H and preferably being of rectangular cross-sectional shape such as defined by left-edge 33, right-edge 34, rear-surface 35, and front-surface 36. Bar 30, having uniform lateral-extent thickness K between surfaces 35 and 36, is provided with at least a first-row of vertically aligned horizontal apertures 111 therethrough. The first-row apertures 111 are at a regular vertical-spacing of a first-spacing value E', each of the apertures 111 being of substantially constant aperture-height D' and aperture-width G'.

As alluded to in FIG. 7, adapter first embodiment 40 is provided by installably inserting receiver-bar member R into a selected channel (e.g. 17, or 18, etc.) of housing component P whereby the receiver-bar apertures 111 are located laterally rearwardly of datum frontal-panel 16 and thereat laterally aligned with the vertical-groove hooks-entry 16G. Thus, as indicated in FIG. 7 phantom lines, the resultant adapter performs analagously to the FIG. 4 prior art situation, namely: hooks-entry vertical-groove 16G is analagous to office-partition cleft 121 and receiver-bar R is analagous to multi-apertures column 110A. However, as seen in FIG. 3, prior art multi-apertures column 110A is constrained at an unalterable fixed distance laterally of frontal-side 122, whereas multi-apertures receiver-bar R is of a selectable lateral distance from datum surface 16D. Accordingly, the FIG. 7 adapter 40 is capable of accommodating more than one "model-design" of multi-hooks brackets (specifically, "model-designs" of more than one hook-length F), but the FIG. 3 prior art structure lacks any such versatility.

Adapter embodiment 40A of FIGS. 8 and 8A has even more versatility than does embodiment 40 in that is is additionally capable of accommodating "model-designs" of more than one detent-height (D) and vertical-spacing (E). In this vein, receiver-bar RA of FIG. 8A is more sophisticated than receiver-bar R of FIGS. 6 and 7, in having a second-row of vertically aligned apertures 112 therethrough. Differing from the first-row apertures 111, each second-row aperture 112 has an aperture-height DD (differing from aperture-height D') and has a vertical-spacing frequency EE (differing from vertical-spacing E'). Thus, depending upon the bracket "model-design" to be accommodated, receiver-bar RA (including an inverted condition) within a housing channel will provide either the first-row apertures 111 or the second-row apertures 112 in lateral registry with hooks-entry vertical-groove 16G.

FIG. 6B indicates that the apertures 111 and 112 of receiver-bars R and RA might be so transversely enlarged as to intersect bar edges 33 and/or 34 and take the form of notches rather than holes. However, the receiver-bar embodiment RAA of FIG. 6B performs analagously to receiver-bar RA of FIG. 6A, though the apertures 111A and 112A of embodiment RAA are notch-type rather than hole-type apertures.

The lateral-width of each housing channel (e.g. 17, or 18, etc.) must, of course, exceed the lateral-extent thickness K of the receiver-bar. For every receiver-bar channel (e.g. 18, etc.) located laterally rearwardly of the forwardmost or first-channel (i.e. 17), the lateral-widths should be substantially equal and less than twice the receiver-bar thickness K. This parameter is indicated as K'. However, the forwardmost or first-channel preferably has a lateral-width K" substantially extending K' whereby a receiver-bar located in this relatively wide first-channel is free to slant (as indicated in FIG. 8A phantom line) so as to accommodate a multi-hooks bracket of the type having transversely skewed hooks.

Wall environment anchoring means for the adapter (40, 40A, etc.) might assume a variety of suitable configurations. An especially apt configuration is the hanger type configuration 20 having an inverted-J cross-sectional shape including an upright shorter leg 21 for the forward-part and that might be attached to rear-panel 15 at housing top-end 11. Hanger 20 also includes upright longer leg 23 depending from horizontal connector-part 22, said longer leg 23 functioning as a rearward-part spaced an offset-distance from the forward-part 21. Screws 25 or other mechanical fasteners might be employed for mounting longer leg 23 to a penetratable wall environment. Adhesive mounting is also possible. And hanger 20 might be employed for suspending the adapter from the upper-edge 125 of office-partition 120, or from an intermediate-elevation horizontal strap 126 extending along office-partition surface 122, or from a shorter multi-hooks type strap (not shown) removably hooked into office-partition column 110A. Certain elongated office equipment, such as shelving, desktops, etc., include a pair of multi-hooks brackets at a fixed spatial separation. In this regard, double-headed arrows in FIG. 10 indicate a slidable condition for paired co-elevational adapters whereby the transversely extending distance therebetween might be adjusted in conformity to the precise spatial separation of the paired brackets for elongated type office equipment.

Though receivable engagement by the multi-apertures receiver-bar (e.g. R, RA, RAA, etc.) with a vertically aligned bracket hooks (e.g. 105) will stably maintain the bracket in condition for suspending office equipment, stability is further enhanced is the frontal-wall parts (e.g. 13A and 14A) exert a transversely extending pinching force upon the hooks shank portions (e.g. 106). As alluded to in FIG. 9, such pinching forces are attainable with alternate housing embodiment PA wherein the tubular member is provided by two separate and cross-sectionally cooperating members 13M and 14M having regular extruded cross-sectional shapes along entire height H. Second-member 14M cross-sectionally provides frontal-panel right-panel 14A, right-side-panel 14 (including inwardly extending wing-like shoulders 14C, 14B and 14A), and a rightwardly extending lip portion 14D. First-member 13M cross-sectionally provides frontal-panel left-panel 13A, leftside-panel 13 (including inwardly extending wing-like shoulders 13C, 13B, and 13A), rear-panel 13D, and guide-panel 13E that includes recess 13F in slidable engagement with lip 14D. The two cooperating members 13M and 14M are in transversely adjustable relationship whereby the frontal-panel vertical-groove space 16GV might be diminished to pinch the bracket hook shanks (e.g. 106) between the frontal-panel parts 13A and 14A. Such transversely adjustable relationship might be effected with setscrews 13S threadedly engaged with guide-panel 13E and bearing against lip 14D of cooperating second-member 14M. Anchoring means 20 is shown attached to rear-panel 3D which is structurally analagous to rear-panel 15 of housing embodiment P.

From the foregoing, the construction and operation of the adapter for receiving multi-hooks brackets will be readily understood and further explanation is believed to be unnecessary. However, since numerous modifications and changes will readily occur to those skilled in the art, it is not desired to limit the invention to the exact constructions shown and described, and accordingly, further modifications and equivalents may be resorted to, as encompassed by the scope of the appended claims.

I claim:

1. Adapter for engageably receiving multi-hooks brackets of various model-designs and being anchorable to a suitable wall environment whereby the bracket engaged multi-hooks bracket might suspendably support office equipment relative to said environmental wall, said wall anchorable adapter comprising:

(A) an upright tubular housing having a finite-height between a top-end and a bottom-end and comprising four interconnected upright-panels including laterally separated rear-panel and frontal-panel and transversely separated leftside-panel and rightside-panel, the housing bottom-end being closed by a base-plate, said four upright-panels providing a vertical-bore of regular non-circular cross-sectional shape for said tubular housing and which shape includes laterally consecutive channels commencing at the frontal-panel, respective housing member channels being cross-sectionally defined by a pair of transversely separated bifurcate housing wings emanating from the leftside-panel and the rightside-panel, each of said housing channels being adapted to slidably receive a selectable receiver-bar downwardly insertable from the housing top-end and thereby providing with respect to the frontal-panel lateral adjustment means for said receiver-bar, said upright frontal-panel having an upright frontal-face extending directionally transversely and uprightly along a frontalface-plane, said frontal-panel being centrally provided with a vertical-groove therethrough and communicating with the channels of the housing vertical-bore;

(B) anchoring means associated with and extending laterally rearwardly of the rear-panel member, said anchoring means being employable for anchoring the frontal-panel with respect to the upright wall environment; and (C) a said receiver-bar having a uniform lateral-extent thickness therealong and provided with at least a vertical first-row and a vertical second-row of laterally horizontal apertures therethrough, said first-row apertures being at a regular vertical-spacing of a first-spacing value, and each of said first-row apertures having a substantially constant aperture-height, said second-row apertures being at a regular vertical-spacing of a second-spacing value differing from said first-spacing value, and each of said second-row apertures having a substantially constant aperture-height differing from the aperture-height for the first-row, whereby upon inversion of the selected receiver-bar within a housing channel, either the first-row or the second-row apertures might be made in lateral registry with said frontal-panel vertical-groove for engagement by the bracket hooks.

2. The adapter of claim 1 wherein said laterally consecutive receiver-bar channels for the housing includes a first-channel located nearest to said frontal-panel, each of said receiver-bar channels that are located laterally rearwardly of the first-channel having a lateral-width that is less than about twice the receiver-bar lateral-extent, and said first-channel having a lateral-width exceeding that of the channels rearwardly thereof whereby a receiver-bar in the relatively wide first-channel is free to conform to a multi-hooks bracket of the type having transversely skewed hooks.

3. The adapter of claim 1 wherein the upright housing member is provided by a pair of upright cooperating members including a first-member separable from a second-member, said first-member providing the frontal-panel left-panel and the leftward bifurcate wings, and the second-member providing the frontal-panel right-panel and the rightward bifurcate wings.

4. The adapter of claim 3 wherein said separatable first-member and second-member are attached in a transversely adjustable relationship whereby the transverse-span of the frontal-panel vertical-groove might be diminished to pinch bracket hooks between the left-panel and the right-panel.

5. The adapter of claim 4 wherein said transversely adjustable relationship is provided by a setscrew passing transversely through one of the two cooperating members and bearing against the other cooperating member.

6. The adapter of claim 1 wherein the anchoring means takes the form of a hanger configuration including a depending rearward-part laterally rearwardly spaced an offset-distance from a forward-part of said hanger.

7. A pair of adapters of claim 1 in anchored condition to an upright environmental wall.

8. The combination of claim 7 for a pair of adapters of the upright housing member type.

9. The combination of claim 8 at substantially co-elevation of said environmental wall, the two adapters being in slidably anchored condition whereby the transverse distance between the adapters is adjustable.

10. Adapter for engageably receiving multi-hooks brackets of various model-designs and being anchorable to a suitable wall environment whereby the bracket engaged multi-hooks bracket might suspendably support office equipment relative to said environmental wall, said wall anchorable adapter comprising:

(A) an upright tubular housing having a finite-height between a top-end and a bottom-end and including a single vertical-bore having a regular non-circular cross-sectional shape, the housing bottom-end being closed by a base-plate, the housing including an upright frontal-panel provided with a vertical-groove therethrough and dividing the frontal-panel into a left-panel shoulder and a right-panel shoulder, the housing cross-sectional shape at the single vertical-bore thereof and commencing at said frontal-panel including at least three laterally consecutive upright channels, each of said channels being forwardly defined by a pair of transversely separated housing shoulders and all of said channels communicating with said same frontal-panel vertical-groove;

(B) anchoring means associated with and extending laterally rearwardly of the housing and being employable for anchoring the frontal-panel with respect to the upright wall environment; and (C) a vertical receiver-bar having a uniform lateral-extent thickness therealong and provided with at least a first-row of vertically aligned laterally horizontal apertures therethrough, said first-row apertures being at a regular vertical-spacing of a first-spacing value, and each of said first-row apertures having a substantially constant aperture-height, and said receiver-bar being slidably vertically receiveable within any one of said at least three laterally consecutive housing channels in a condition wherein the receiver-bar is located laterally rearwardly of the housing frontal-panel with the first-row apertures being in lateral registry with said frontal-panel vertical-groove, whereby the selected housing channel locale determines a lateral adjustment means for the apertured receiver-bar with respect to the housing frontal-panel.

11. The adapter of claim 10 wherein the upright housing is provided by a pair of cooperating upright members including a first-member providing the left-panel shoulder and leftward portions of said housing channels, and including a second-member transversely movable with respect to the first-member and providing the right-panel shoulder and rightward portions of said housing channels.

* * * * *